US008272151B2

(12) United States Patent
Ries et al.

(10) Patent No.: US 8,272,151 B2
(45) Date of Patent: Sep. 25, 2012

(54) HOIST AND DRAG SYSTEM FOR MINING

(75) Inventors: William Ries, Brookfield, WI (US); Gregory Feld, Franklin, WI (US); Robert Vallier, Sullivan, WI (US); Eric Evenson, Racine, WI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 167 days.

(21) Appl. No.: 12/793,223

(22) Filed: Jun. 3, 2010

(65) Prior Publication Data

US 2011/0296721 A1 Dec. 8, 2011

(51) Int. Cl.
*E02F 9/02* (2006.01)

(52) U.S. Cl. ..... 37/395

(58) Field of Classification Search ..... 37/394, 37/395, 396, 397, 307–309; 74/410, 397, 74/421, 395, 396; 180/8.1, 8.5, 8.6; 212/245, 212/247, 175, 179; 414/687, 694, 695.8; 475/331–342

See application file for complete search history.

(56) References Cited

U.S. PATENT DOCUMENTS

| | | | | |
|---|---|---|---|---|
| 4,098,139 | A * | 7/1978 | Sankey | 74/410 |
| 5,078,285 | A | 1/1992 | Geyer et al. | |
| 5,279,173 | A | 1/1994 | Blaszynski et al. | |
| 5,522,536 | A | 6/1996 | Kallenberger | |
| 5,571,225 | A | 11/1996 | David | |
| 5,600,905 | A | 2/1997 | Kallenberger et al. | |
| 5,603,174 | A * | 2/1997 | Kallenberger et al. | 37/394 |
| 6,035,736 | A * | 3/2000 | Gyllner et al. | 74/397 |
| 7,350,606 | B2 | 4/2008 | Brill et al. | |

* cited by examiner

*Primary Examiner* — Robert Pezzuto
(74) *Attorney, Agent, or Firm* — Foley & Lardner LLP

(57) ABSTRACT

Equipment for mining and excavating includes a bucket used to remove overburden, a boom for positioning the bucket, and a hoist and drag cable for controlling the bucket. The equipment also includes a drum; a pedestal, a pinion assembly, and a cartridge assembly. The drum is used to wind the hoist cable or the drag cable. The pedestal supports the drum and surrounds a bull gear attached to the drum. A pinion of the pinion assembly extends within a port in the pedestal to engage the bull gear. The cartridge assembly is attached to the pedestal and includes an electric motor having a shaft extending from the motor, and a gear reduction coupled to the motor shaft. The pinion assembly is driven by the motor via the gear reduction. The pedestal allows the pinion assembly and other components to be removed or installed, without entirely separating the cartridge assembly from the pedestal.

20 Claims, 15 Drawing Sheets

HOIST AND DRAG SYSTEM FOR MINING

BACKGROUND

The present disclosure relates generally to the field of mining and excavation systems. More specifically, the present disclosure relates to hoist and drag systems for use with mining equipment, such as draglines and power shovels.

Draglines, power shovels, and even sub-surface mining systems often use large hoist and drag systems or mechanisms for deploying and retrieving mining implements. The mining implements, such as buckets, shovels, and lines, collect and move heavy deposits. For example, in strip mining operations an upper layer of soil or rock called "overburden" is removed with large shovels and buckets to expose a seam of mineral deposits or other material to be mined.

Draglines and power shovels are typically very large pieces of mining equipment. By way of example, a dragline may include a boom on the order of 150 to 435 feet long, a bucket sized to move nearly 400 tons of material per cycle, and a housing for storing the main machinery of the dragline, where one small portion of the housing includes a bridge for a human operator. Draglines operate by dragging the bucket over a surface of the mine to collect the overburden. The bucket is then moved so that the overburden may be dumped away from the dig area. Such maneuvering of the bucket is typically accomplished via a hoist and drag system.

Hoist and drag systems are not limited to draglines. Such systems may be used with a broad range of mining and other heavy equipment. Some excavators and conveyors use hoist and drag systems to maneuver a working implement or to transport material. Power shovels, stripping shovels, front shovel, electric mining shovels, and other such mining equipment use hoist and drag systems to maneuver a bucket. Outside of mining, for example, hoist and drag systems may be used with construction equipment to maneuver other equipment and materials.

SUMMARY

One embodiment relates to equipment for mining and excavating. The equipment includes a bucket that may be used to remove overburden, a boom for positioning the bucket, and hoist and drag ropes (e.g., cable, wires, etc.) for controlling the bucket. The equipment also includes one or more drums, pedestals, pinions, and cartridge assemblies. A drum is used to wind the hoist ropes or the drag ropes. A pedestal supports the drum and surrounds a bull gear attached to the drum. A pinion extends through a port in the pedestal and engages the bull gear. A cartridge assembly is attached to the pedestal and includes an electric motor having a shaft extending from the motor, and a gear reduction attached to the shaft. One or more pinions is driven by the motor via the gear reduction. The pedestal allows the pinion to be removed or installed, without detaching the cartridge assembly from the pedestal.

Another embodiment relates to hoist and drag machinery. The hoist and drag machinery includes one or more drums on which ropes are wound, one or more bull gears connected to at least one of the drums, one or more pedestals supporting the drum and the bull gear, a pinion assembly, and a cartridge assembly fastened to the pedestal. The cartridge assembly includes a housing, a motor, and a gear reduction. The motor has an output shaft extending within the housing. The gear reduction is connected to the output shaft of the motor. The pinion assembly is connected to the gear reduction, and engages the bull gear. The motor, the gear reduction, and the pinion assembly are separately supported such that the motor is removable from the cartridge assembly without first maneuvering the gear reduction or the pinion assembly. The gear reduction is removable from the cartridge assembly without first maneuvering either the motor or the pinion assembly. And the pinion assembly is separable from the gear reduction without first maneuvering the cartridge assembly.

Yet another embodiment relates to a cartridge assembly for machinery, such as either hoist or drag machinery. The cartridge assembly includes a housing having a cover, an electric motor attached to the housing, a gear reduction having a planetary gear arrangement, and a motor coupling. The cover is designed to provide access through the top of the housing. The motor includes an output shaft extending within the housing. The gear reduction includes an input shaft and at least one output ports. An output port is designed to be attached to a pinion assembly. The motor coupling aligns the output shaft of the electric motor and the input shaft of the gear reduction.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
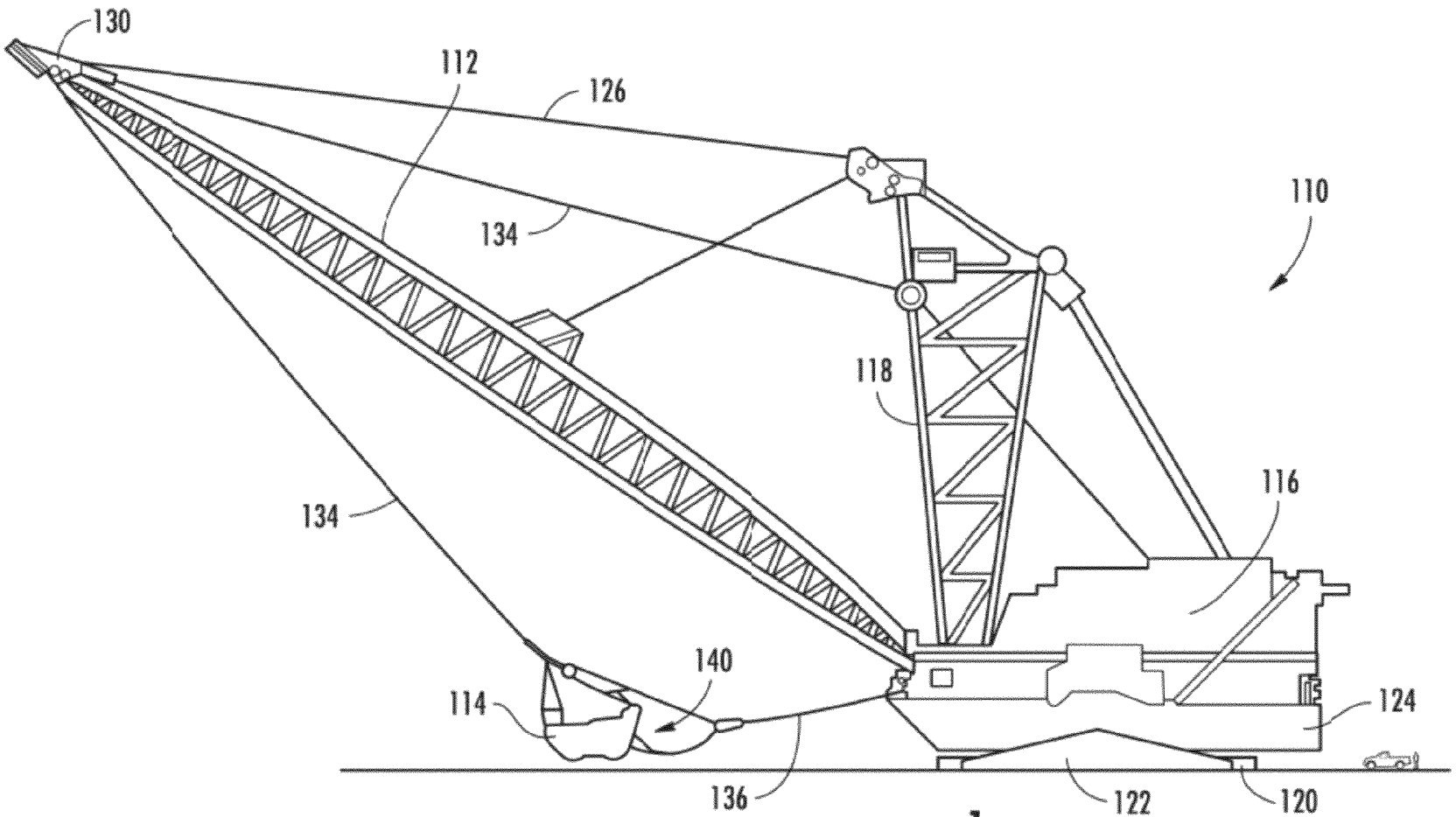
FIG. 1 is a side view of a dragline according to an exemplary embodiment.

Referring to FIG. 1, mining equipment in the form of a dragline 110 includes a boom 112, a bucket 114, and a housing 116. The housing 116 is fastened to a frame 124 that is rotatably connected to a base 120 of the dragline 110. The boom 112 extends from the housing 116, and is designed to vertically pivot. During operation, the boom 112 may be supported at a desired orientation by pendants 126 extending from a distal end 130 of the boom 112, to a gantry 118. The dragline 110 is a "walking dragline," movable on pontoons 122 coupled to the base 120. Other embodiments may include with other forms of equipment, such as power shovels, subsurface conveyors, etc.

Figure 2:
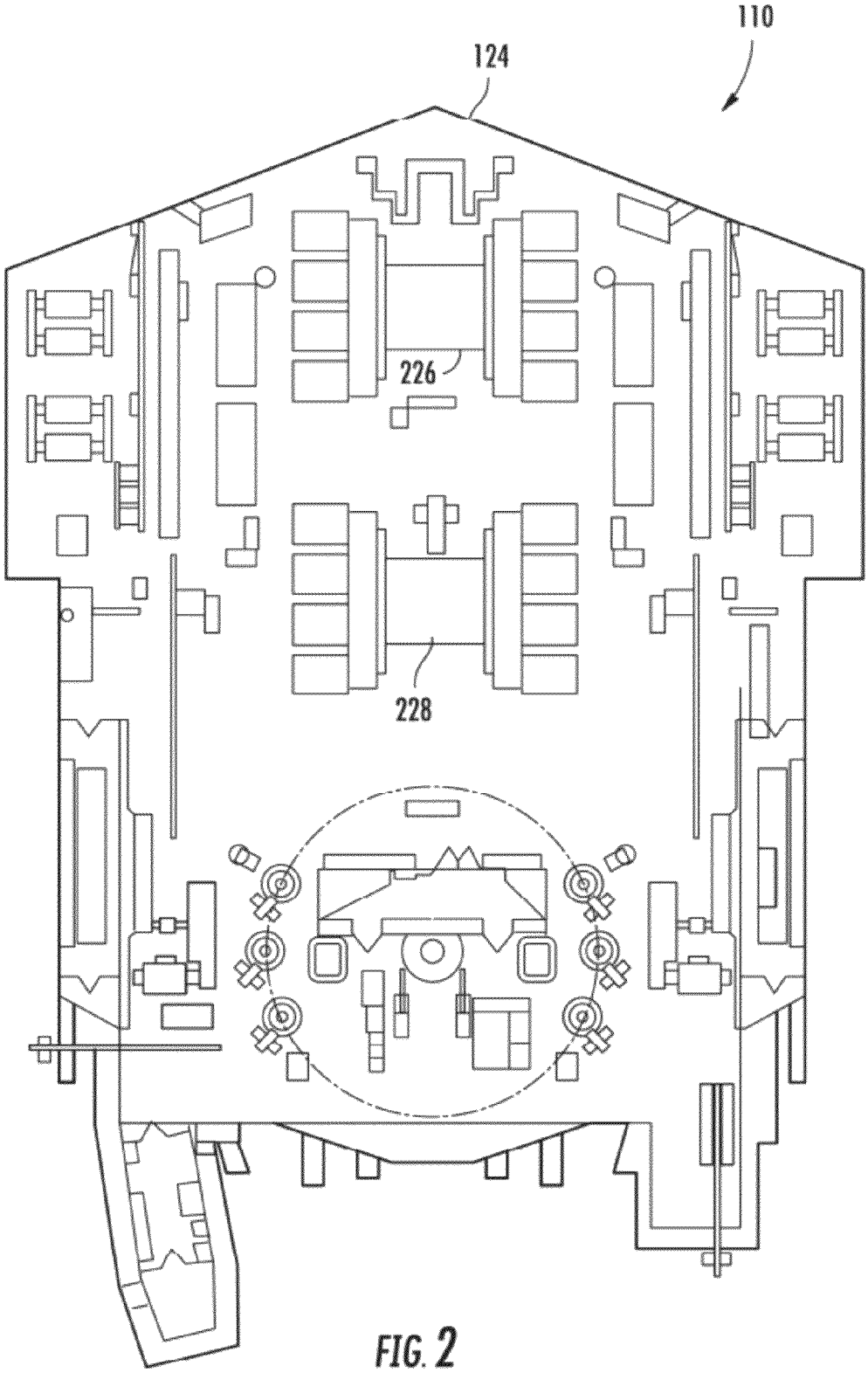
FIG. 2 is a floor plan of a dragline according to an exemplary embodiment.

Referring to FIGS. 1-2, through the use of hoist and drag machinery, the dragline 110 is configured to remove large volumes of overburden. According to an exemplary embodiment, the bucket 114 may be maneuvered with hoist ropes 134 (e.g., wires, steel cables, lines, etc.) and/or drag ropes 136. During operation of the dragline 110, as the hoist ropes 134 are wound around a hoist drum 226 (see FIG. 2; see also drag drum 228) in the housing 116, the bucket 114 is lifted toward the distal end 130 of the boom 112. The bucket 114 may then be maneuvered to a desired position via the boom 112, with an open end 140 of the bucket 114 facing the housing 116. Unwinding of the hoist ropes 134 from the hoist drum 226, then lowers the bucket 114, which may be drawn along the ground toward the housing 116. Dragging the bucket 114 fills the bucket 114 with overburden. The bucket 114 may then be raised and rotated to release the overburden in a desired location. This process repeats.

Figure 3:
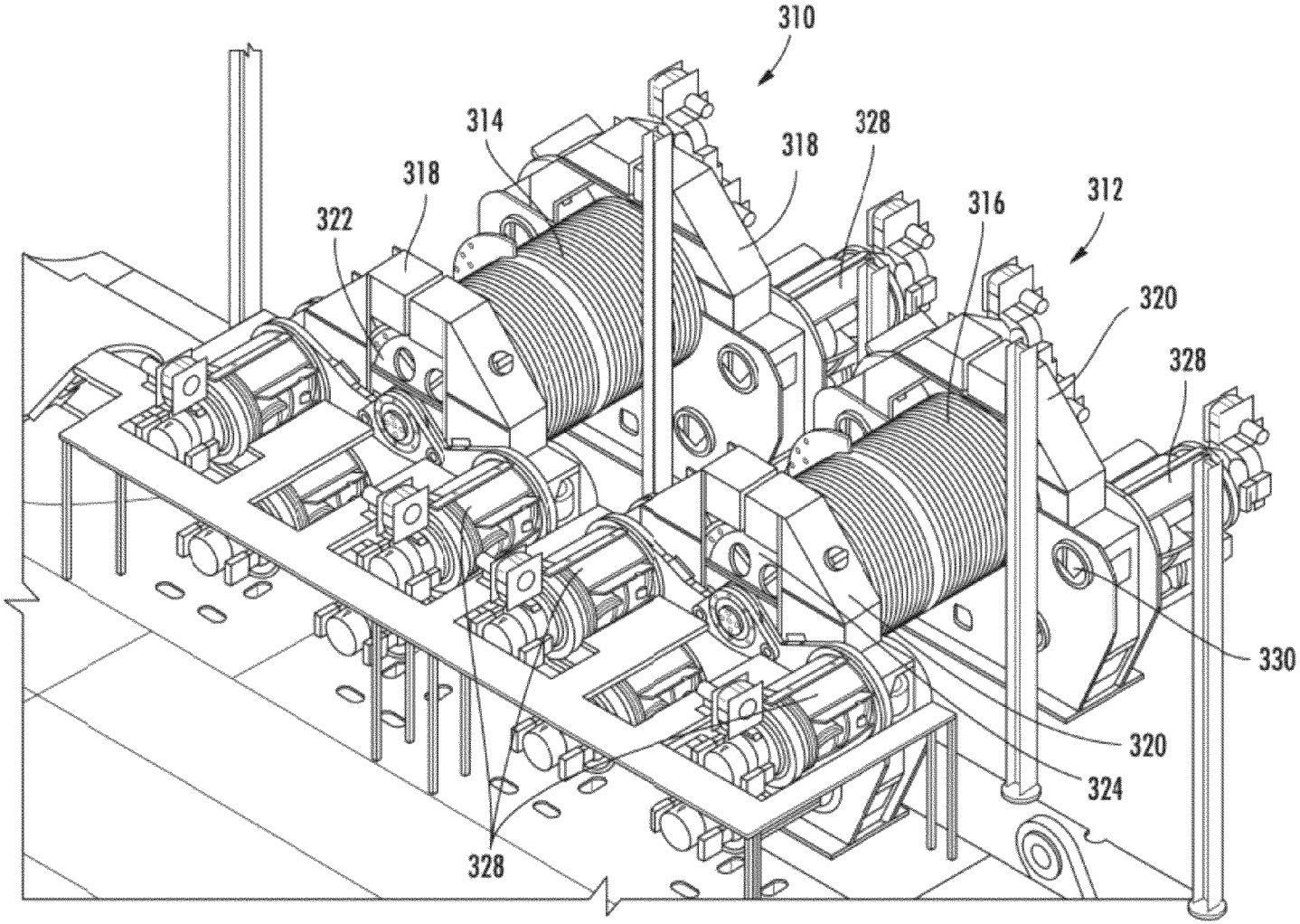
FIG. 3 is a perspective view of hoist and drag machinery in a first configuration according to an exemplary embodiment.
Figure 5:
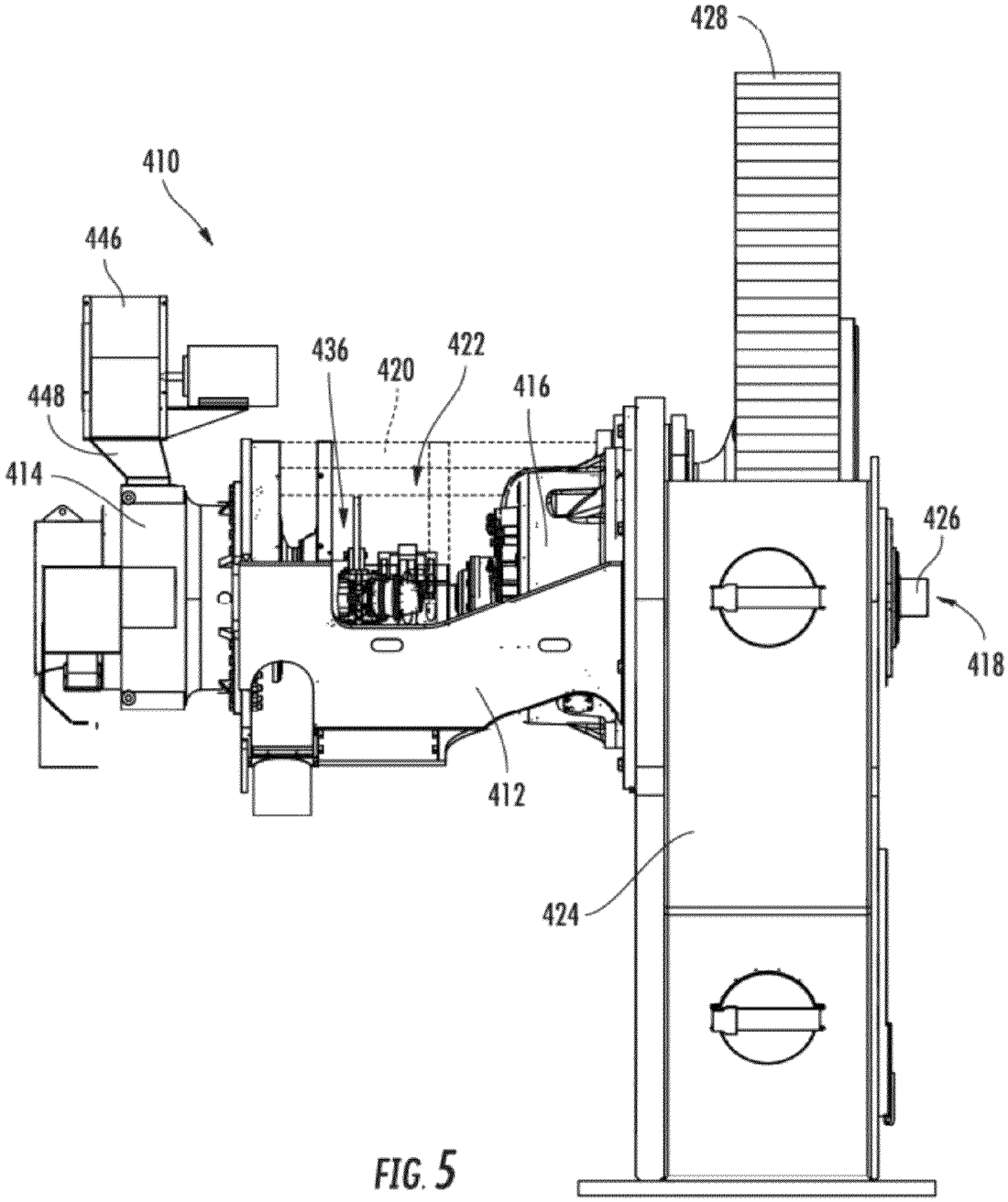
FIG. 5 is a side view of the hoist and drag machinery of FIG. 4.

Referring to FIG. 3 hoist and drag machinery 310, 312 for mining equipment includes the hoist drum 314 and/or a drag drum 316. Each drum 314, 316 is rotatably supported on a pedestal 318, 320, and is coupled to a bull gear 322, 324. The bull gears 322, 324 have configured to be driven by one or more pinion assemblies (e.g. pinion assembly 418 as shown in FIG. 5) driven by cartridge assemblies 328. In some embodiments, the bull gears 322, 324 are provided on either end of drums 314, 316 and each bull gear 322, 324 may be driven by one or more pinion assemblies (e.g., pinions and related components). In other embodiments, hoist and drag machinery includes a bull gear, pinion assemblies, and cartridge assemblies positioned on only one end of the drum.

Figure 4:
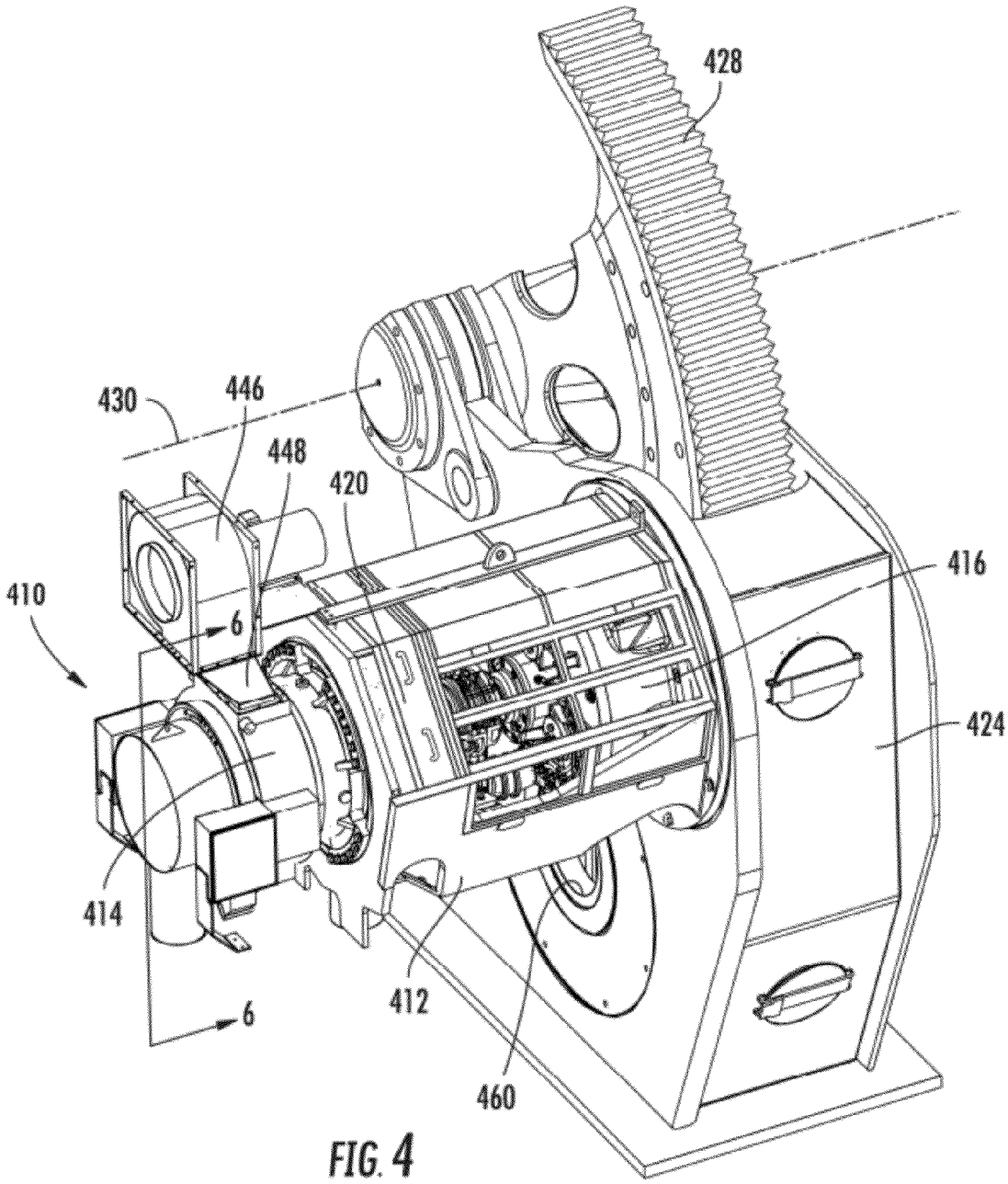
FIG. 4 is a perspective view of a portion of hoist and drag machinery according to another exemplary embodiment.

Referring to FIG. 4 each cartridge assembly 410 includes a housing 412, a motor 414, and a gear reduction 416, and may be coupled to a pinion assembly 418 (see FIG. 5). The housing 412 includes a cover 420, allowing access to internal components of the cartridge assembly 410 (e.g., gear reduction 416) through an opening 422 in a top of the housing 412. In some embodiments, the gear reduction 416 is provided within the housing 412, while the motor 414 and the pinion assembly 418 extend from opposite ends of the housing 412. In other embodiments, a cartridge assembly 410 may not include a closed housing, or may include other housing components, such as a rigid frame configured to be coupled to the pedestal.

The cartridge assembly 410 is attached to a pedestal 424, and the pinion assembly 418 is coupled to the cartridge assembly 410. The pinion assembly 418 is inserted through a port in a pedestal (e.g. port 330 as shown in FIG. 3), with a pinion 426 engaged with a bull gear 428. The pedestal 424 includes ports for additional pinion assemblies and cartridge assemblies, positioned around an axis of rotation 430 of the drum and the bull gear 428, such as at a distance equidistant from the axis of rotation 430. By way of non-limiting example, four cartridge assemblies 410 and pinion assemblies 418 may be arranged around the bull gear 428 in a planetary arrangement, where the bull gear 428 is the sun gear and the pinions 426 of the pinion assemblies 418 are the planet gears.

Depending upon desired capacity of the hoist and drag machinery, more or fewer cartridge assemblies 410 (and pinion assemblies 418) may be coupled to the bull gear 428. Also, a hoist machinery may have a different number or arrangement of cartridges 410 than a drag machinery. While the cartridge assemblies 410 and pinion assemblies 418 are shown as arranged around a lower portion of the bull gear 428 in FIGS. 3-4, in other embodiments, cartridge assemblies 410 and pinion assemblies 418 may be otherwise provided on the bull gear 428. According to still other embodiments, hoist or drag machinery may have parallel-shaft gearing instead of planetary gearing, with an intermediate gear reduction provided between a cartridge assembly and a drum.

Referring to FIGS. 4-5, the cartridge assemblies 410 include one or more parts or sub-assemblies that may be partially assembled outside a dragline (or other equipment), and partially assembled using an overhead crane (see FIG. 12) or other pulley or hoist system within the housing of the dragline. In some embodiments, the overhead crane may be integrated with the dragline housing, forming part of an overall hoist and drag machinery. According to an exemplary embodiment, the overhead crane maneuvers the cartridge assemblies 410 and components thereof with minimal disruption to surrounding components (e.g., moving, removing, disassembling, etc. of surrounding components), reducing time costs associated with repairing or replacing parts.

Figure 6:
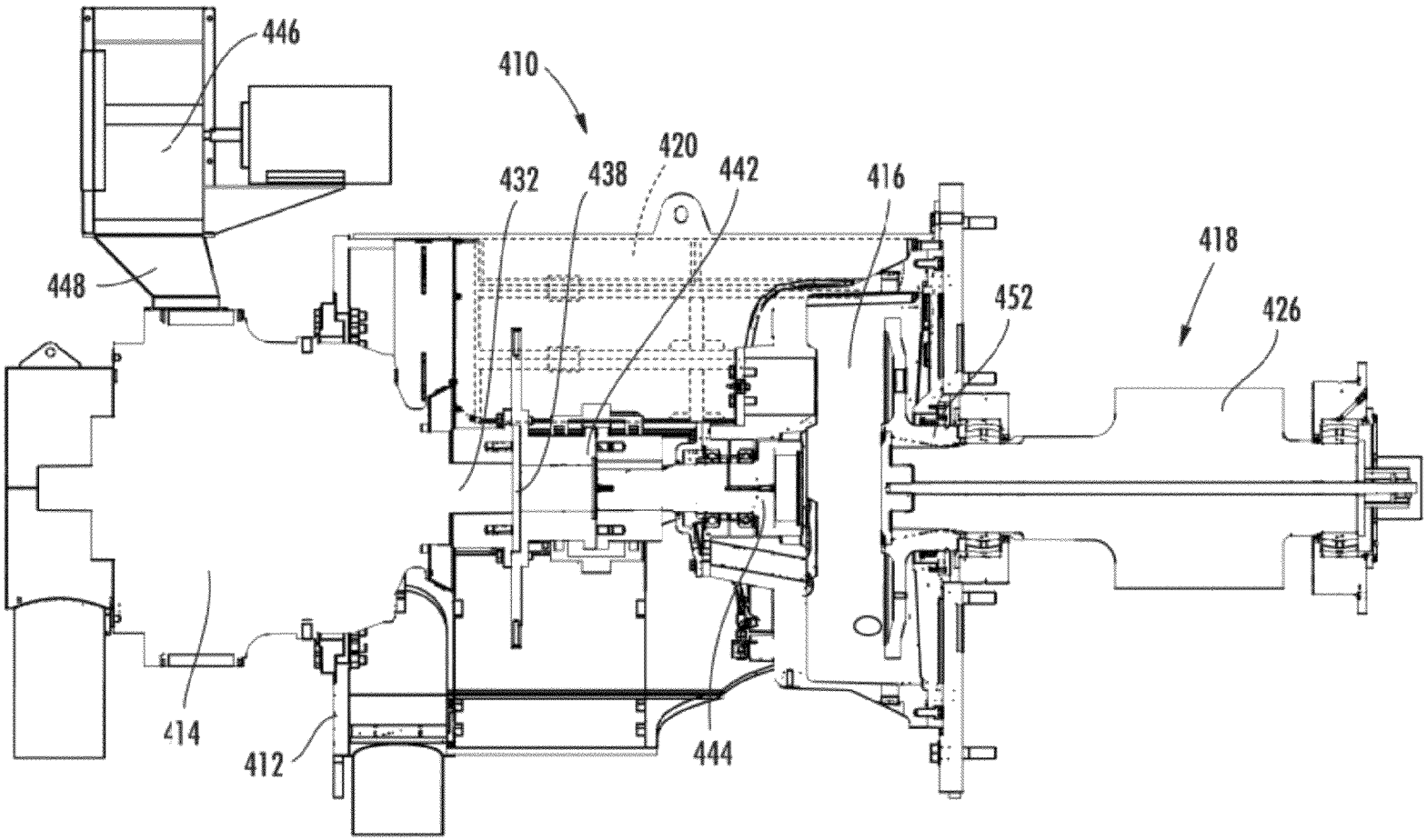
FIG. 6 is a sectional view of a portion of the hoist and drag machinery of FIG. 4 taken along line 6-6.

Referring to FIG. 6, the motor 414 (e.g., electric motor, engine, etc.) for the cartridge assembly 410 is attached to the housing 412 and includes an output shaft 432 (e.g., power take-off, coupling, etc.) that extends into the housing 412. In some embodiments, the motor 414 is attached to the housing 412 with bolts and mounting flanges. Similar bolts and flanges may be used to couple the cartridge assembly 410 to the pedestal 424 (as shown in FIG. 5), and to fasten other components of the cartridge assembly 410 together, or to the pedestal 424. In other embodiments, other commercially-available fasteners and fastening methods are used.

Figure 7:
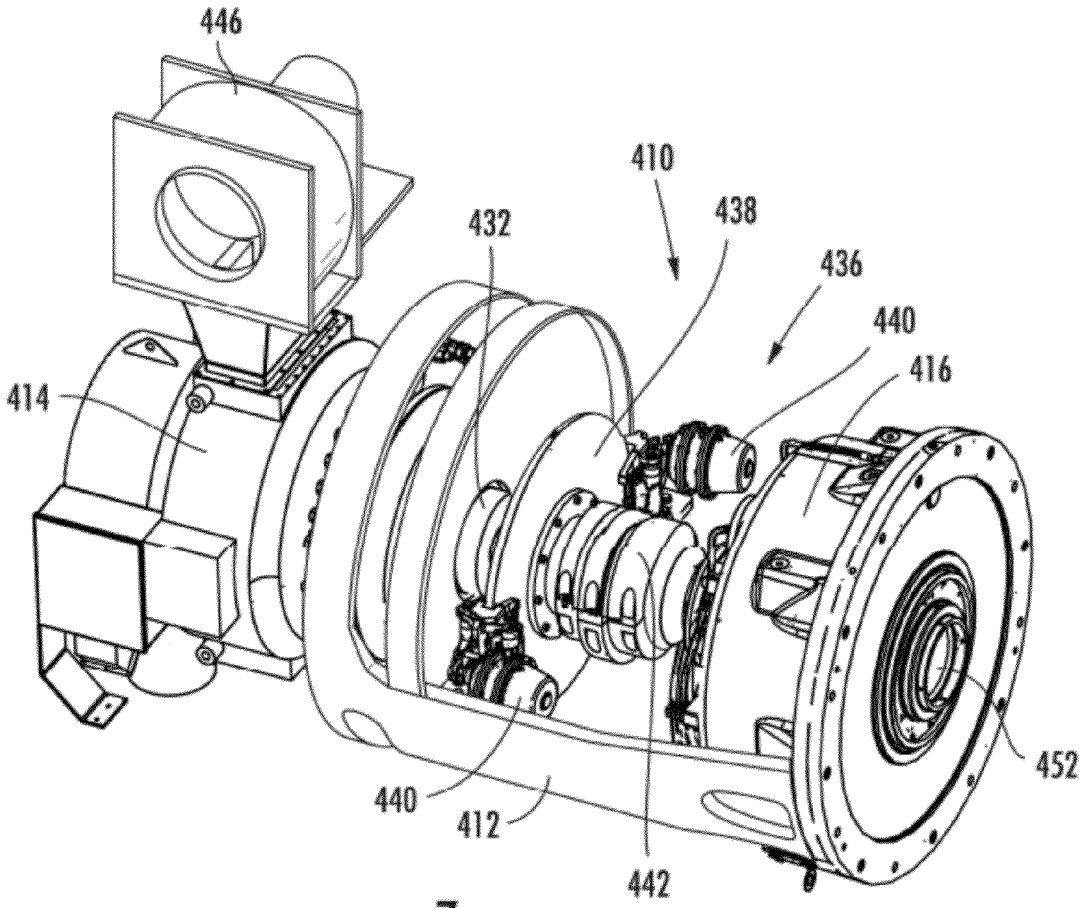
FIG. 7 is a perspective view of a cartridge assembly according to an exemplary embodiment.

Referring to FIG. 7, the motor 414 may be stopped via a braking mechanism 436 positioned in the cartridge assembly 410. According to an exemplary embodiment, the braking mechanism 436 includes a disc 438 (e.g., rotor, etc.) attached to the output shaft 432 of the motor 414 and one or more brake calipers 440 (e.g., pads, etc.) mounted proximate to the brake disc 438. The brake calipers 440 may be actuated (e.g., hydraulically, electrically, mechanically, pneumatically, etc.) to halt rotation of the disc 438 and, in turn, rotation of the output shaft 432 of the motor 414. A motor coupling 442 (e.g., pilot sleeve, guide, flange coupling, etc.) is provided to align the output shaft 432 of the motor 414 and an input shaft 444 of the gear reduction 416, reducing or removing a need for fine-tune adjustment (e.g., shimming) of the motor 414 or other components. The cartridge assembly 410 is shown in a round or cylindrical rolled-plate housing configuration, however in other embodiments the housing may be formed by welding flat plates to form a U-shape.

Figure 8:
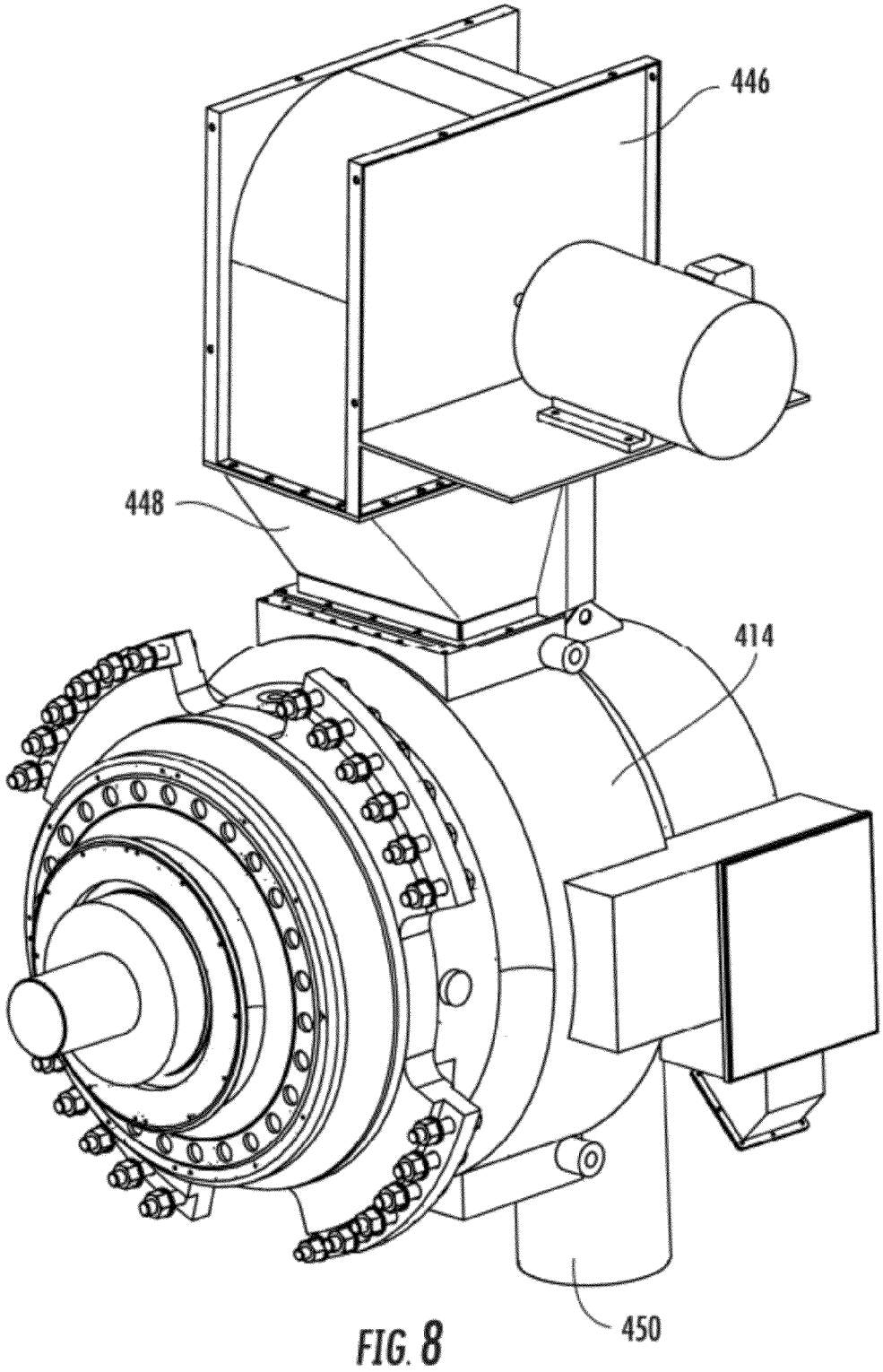
FIG. 8 is a perspective view of a motor according to an exemplary embodiment.

Referring to FIG. 8, cooling for the motor 414 may be provided by a fan 446 (e.g., centrifugal fan). Air is directed toward the motor 414 of the cartridge assembly 410 through a duct 448 attached to the motor 414, and then directed away from the motor 414 through an exhaust duct 450. The fan 446 and the ducts 448, 450 are arranged such that the cover 420 of the housing 412 may be freely removed to service components of the cartridge assembly 410 within the housing 412. In other embodiments, the motor 414 may be otherwise cooled, such as with a liquid cooling system.

Figure 9:
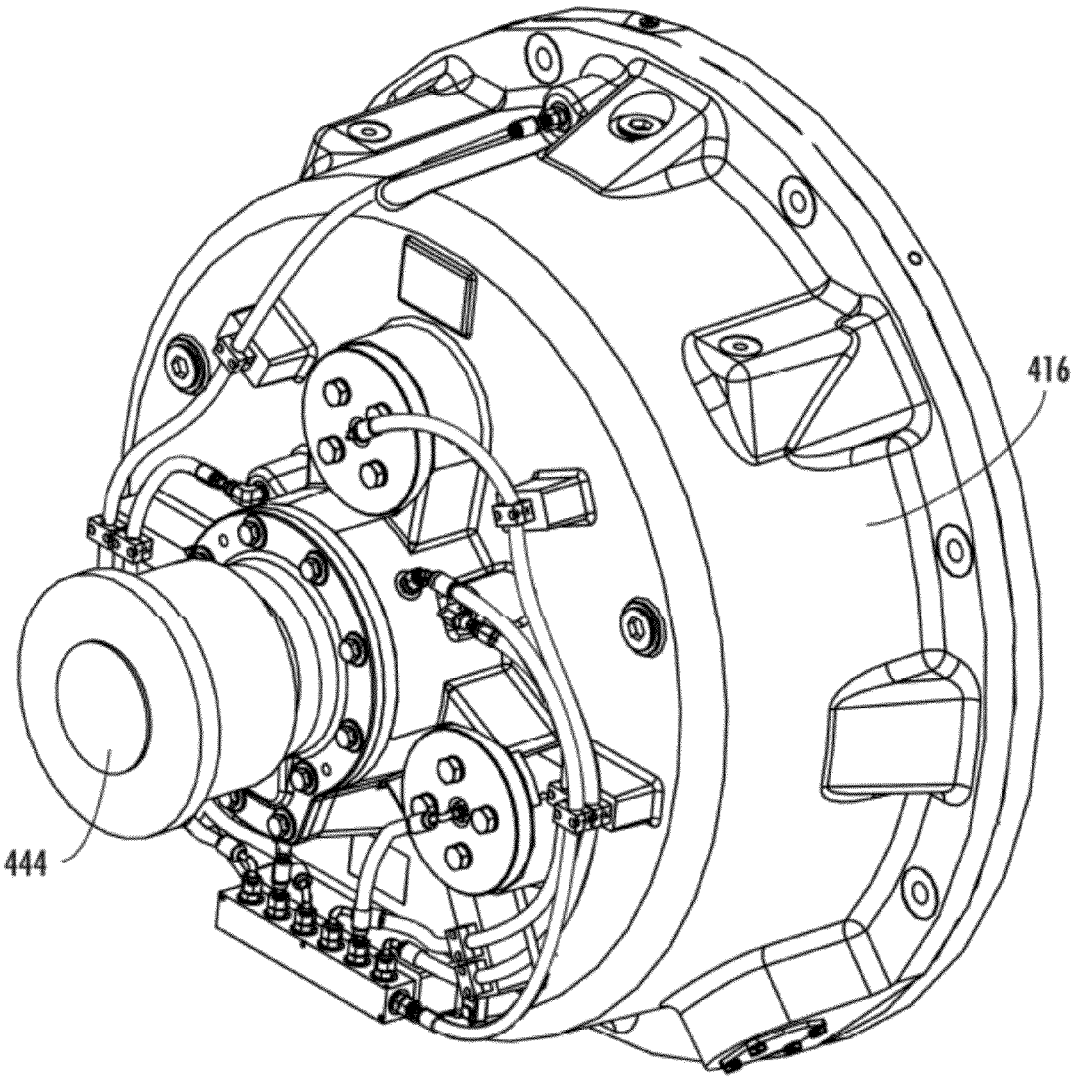
FIG. 9 is a perspective view of a gear reduction according to an exemplary embodiment.

Referring to FIG. 9, the cartridge assembly 410 includes the gear reduction 416 (e.g., transmission, gear box, etc.). The output shaft 432 of the motor 414 is coupled to an input shaft 444 of the gear reduction 416, and an output port 452 (See FIG. 6) of the gear reduction 416 is configured to receive the pinion 426 of the pinion assembly 418. In some embodiments, the gear reduction 416 includes an output shaft and/or an input port. According to an exemplary embodiment, the gear reduction 416 includes a planetary gear arrangement, for providing a speed-torque conversion between the motor 414 and the pinion assembly 418. In other embodiments, a gear reduction may include a parallel shaft transmission.

Figure 10:
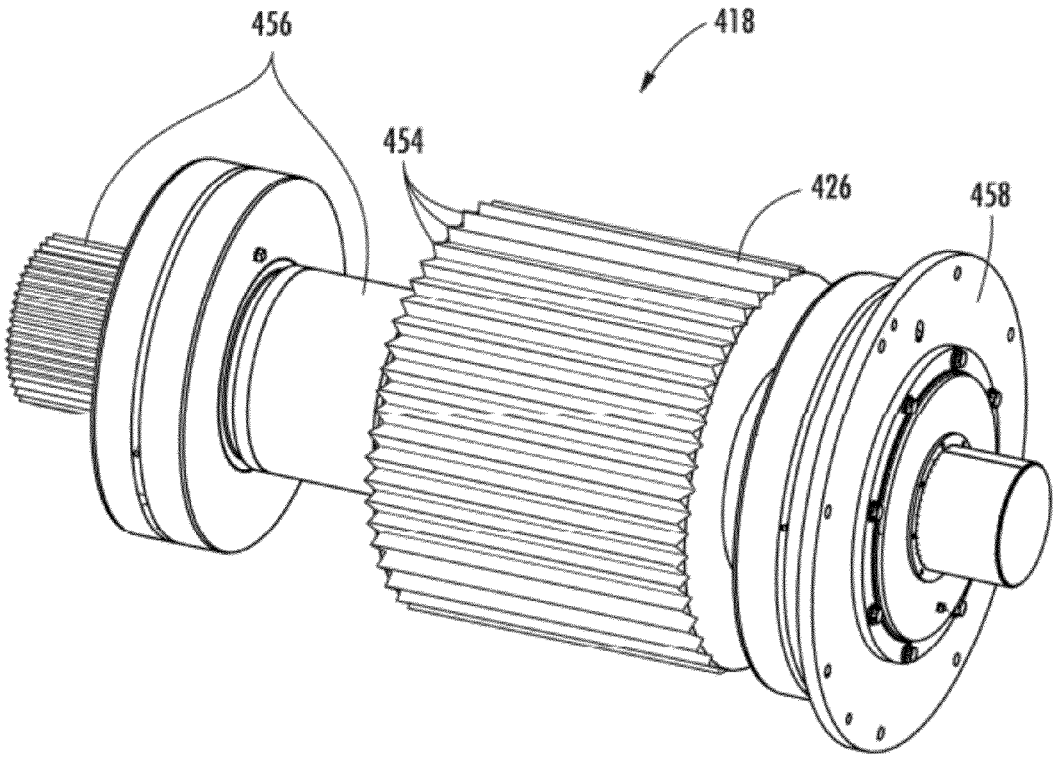
FIG. 10 is a perspective view of a portion of a pinion assembly according to an exemplary embodiment.

Referring to FIG. 10, the pinion assembly 418 includes the pinion 426 with gear teeth 454, an input shaft 456, and a mounting flange 458 (e.g., bearing carrier). The pinion 426 is rotationally coupled to the output port 452 of the gear reduction 416, such as via a splined or keyed connection. The pinion assembly 418 extends outward from the housing 412 of the cartridge assembly 410, away from the motor 414, and is coupled to the pedestal 424. The pinion assembly 418 extends into a port 460 (See FIG. 4) in the pedestal 424 such that the gear teeth 454 engage teeth of the bull gear 428. The mounting flange 458 allows the pinion assembly 418 to rotate relative to the pedestal 424.

Referring to FIGS. 4-10, the hoist and drag machinery may be assembled in particular configurations. In some embodiments, the motor 414 and the gear reduction 416 are coupled to the housing 412 of the cartridge assembly 410, with the gear reduction 416 and the motor 414 independently supported. The motor 414 is adjacent to the housing 412 and attached to the outside of the housing 412 with the output shaft 432 of the motor 414 extending into the housing 412. The gear reduction 416 is located within the housing 412 and is attached to a side of the housing 412 that is opposite to the motor 414. Additionally, the motor coupling 442, the brake disc 438, and the brake calipers 440 are positioned inside the housing 412, such as between the motor 414 and the gear reduction 416.

According to an exemplary embodiment, the output shaft 432 of the motor 414 is rotatably coupled to the input shaft 444 of the gear reduction 416 with the motor coupling 442 (e.g., mating flanges bolted together). The housing 412 of the cartridge assembly 410 is then aligned with the port 460 on the pedestal 424 and attached to the pedestal 424 (e.g., bolted, or welded thereto, etc.). Further, the pinion assembly 418 is inserted into a side of the pedestal 424 that is opposite to the side of the pedestal 424 to which the cartridge assembly 410 is fastened. Upon insertion, the pinion assembly 418 is configured to engage both the output port 452 of the gear reduction 416 and the bull gear 428.

According to an exemplary embodiment, each of the motor 414, the gear reduction 416, and the pinion assembly 418 are independently removable from the cartridge assembly 410 without each of the other components being removed, such as for maintenance or replacement purposes of one component. Reducing the number of components that must be removed to service the motor 414, the gear reduction 416, or the pinion assembly 418 decreases downtime.

Figure 11:
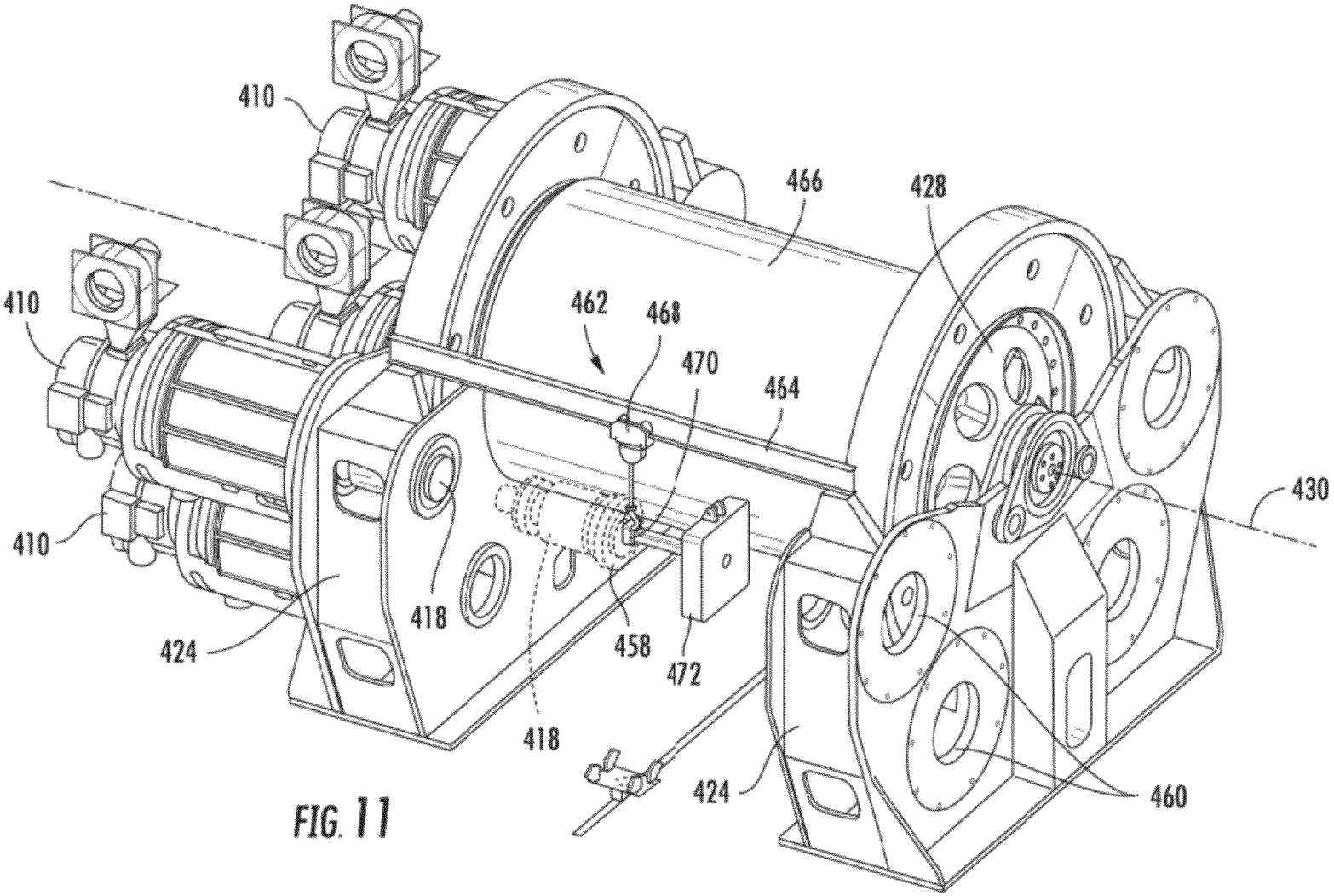
FIG. 11 is a perspective view of the hoist and drag machinery of FIG. 3 in a second configuration.

Referring to FIG. 11, a pinion assembly 418 is shown in a process of being removed via an auxiliary hoist system 462, such as for repair or replacement. According to an exemplary embodiment, the auxiliary hoist system 462 includes a rail 464 coupled to pedestals 424 and aligned parallel to the rotational axis 430 of the drum 466. The auxiliary hoist system 462 further includes a trolley 468 that may travel along the rail 464, having a hook 470 suspended therefrom.

To remove the pinion assembly 418 from the pedestal 424, a counterweight 472 is connected (e.g. bolted, latched, hooked, etc.) to the pinion assembly 418. The counterweight 472 is engaged by the hook 470, and the mounting flange 458 of the pinion assembly 418 is disconnected from the pedestal 424. The pinion assembly 418 may then be disengaged from the gear reduction 416 as the pinion assembly 418 is pulled out of the pedestal 424, away from the cartridge assembly 410. The counterweight 472 is configured to balance the pinion assembly 418 so that the pinion assembly 418 may remain generally level as the trolley 468 is moved along the rail 464 and the pinion assembly 418 is pulled away from the pedestal 424, reducing the likelihood that the pinion assembly 418 will be damaged by inadvertently impacting the pedestal 424. To install the pinion assembly 418, the process may be reversed.

Figure 12:
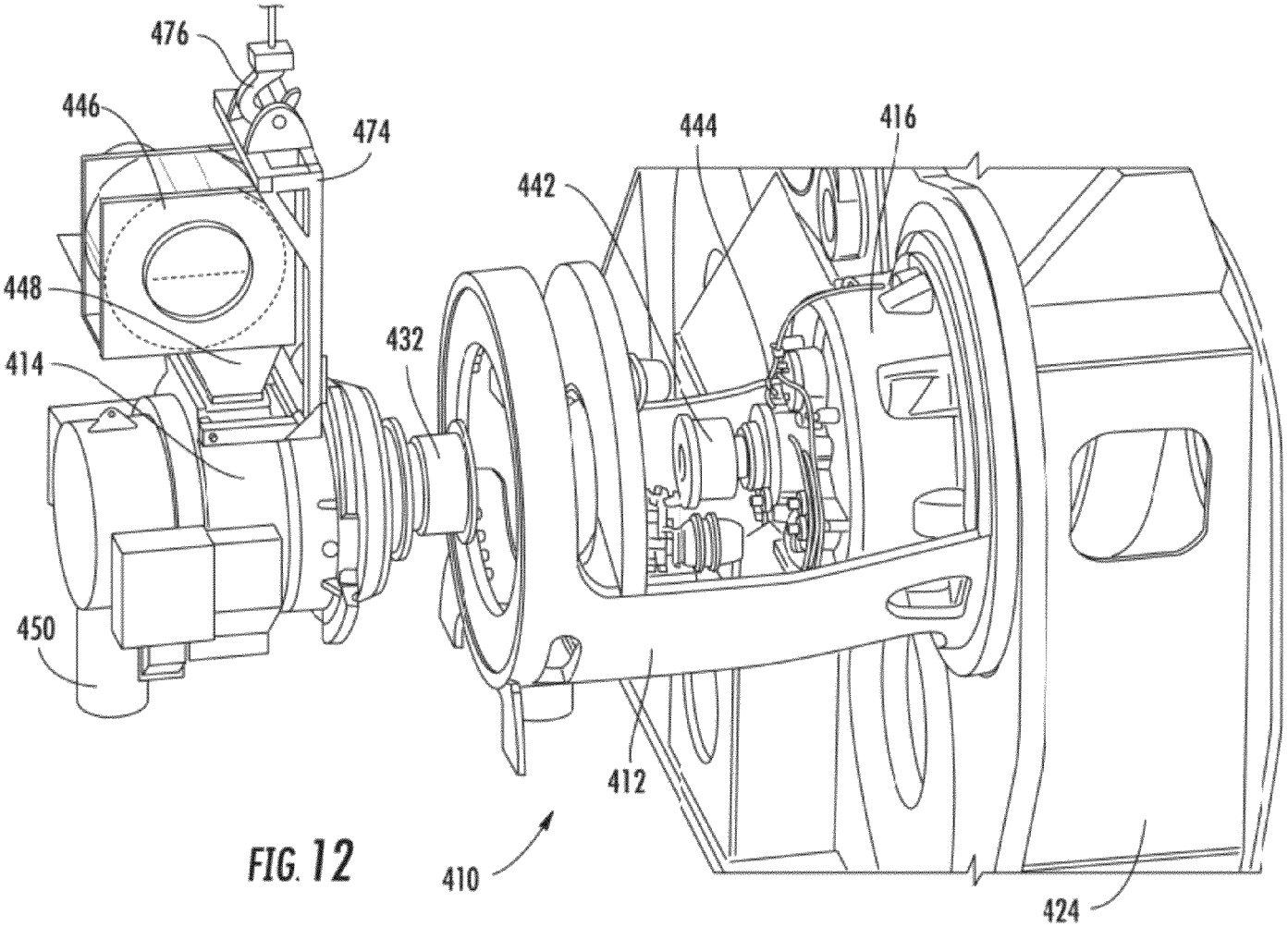
FIG. 12 is a perspective view of the hoist and drag machinery of FIG. 3 in a third configuration.

Referring to FIG. 12, the motor 414 is shown in a process of being removed, such as for purposes of being repaired or replaced. Ducting 448 connected to the motor 414 may be removed to provide clearance for the removal of the motor 414. The motor coupling 442 may be separated and/or removed to disconnect the motor 414 from the gear reduction 416. The brake disc 438 is disconnected from the motor 414. In some embodiments, a support 474 (e.g., brace, bracket, lug, fixture, etc.) is coupled to the motor 414 to provide a structure that may be engaged by a hook 476 of the overhead crane system. The support 474 is shaped such that the hook 476 engages the support 474 at a point where the attached components are balanced and less likely to tip when pulled away from the cartridge assembly 410. The hook 476 of the overhead crane system engages the support 474 and supports the weight of the motor 414. The motor 414 may then be disconnected from the housing 412 of the cartridge assembly 410 and pulled sideways, clear of the cartridge assembly 410 until the output shaft 432 of the motor 414 is free of the housing 412. To install the motor 414, the process may be reversed.

Figure 13:
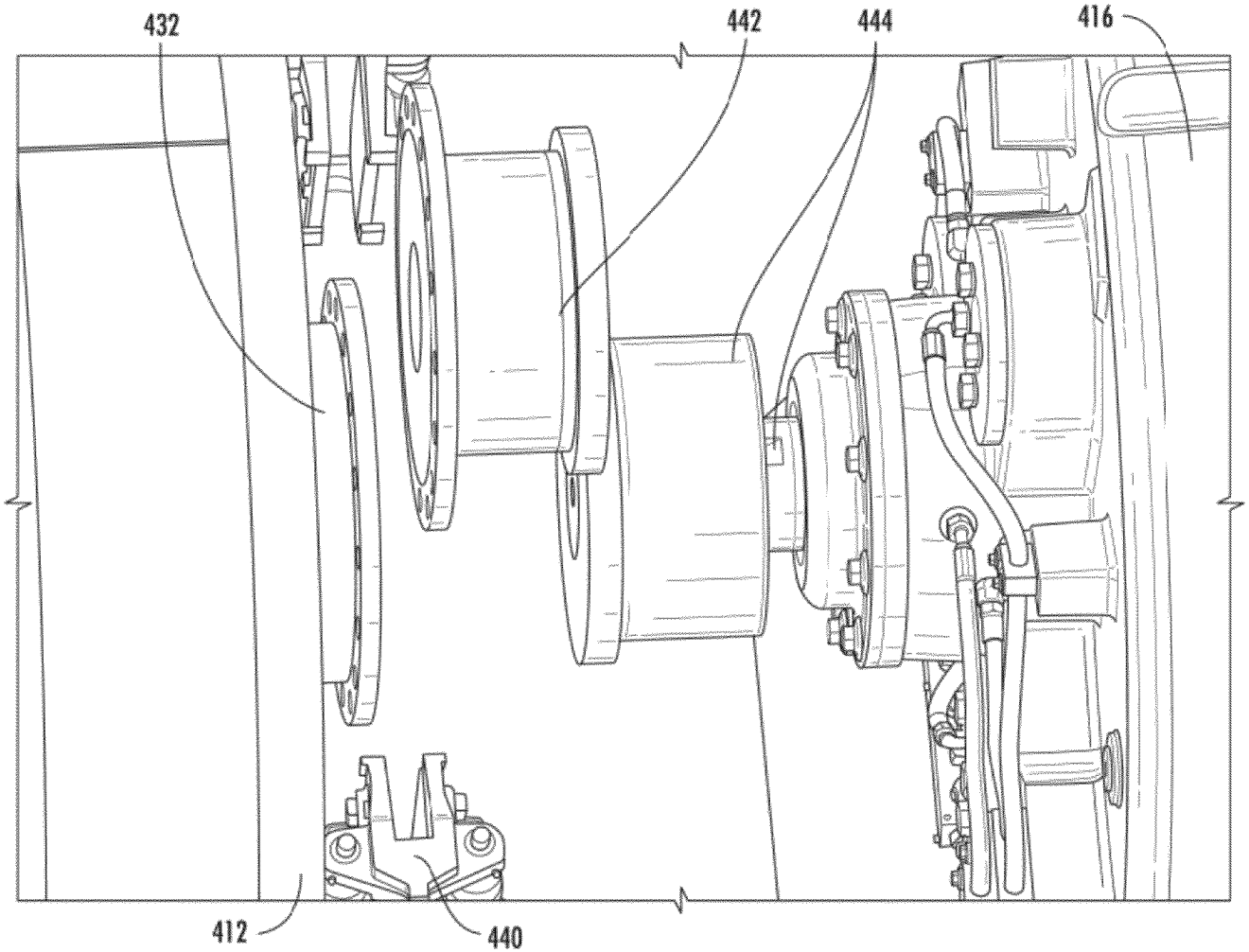
FIG. 13 is a perspective view of a cartridge assembly in a first configuration according to an exemplary embodiment.
Figure 14:
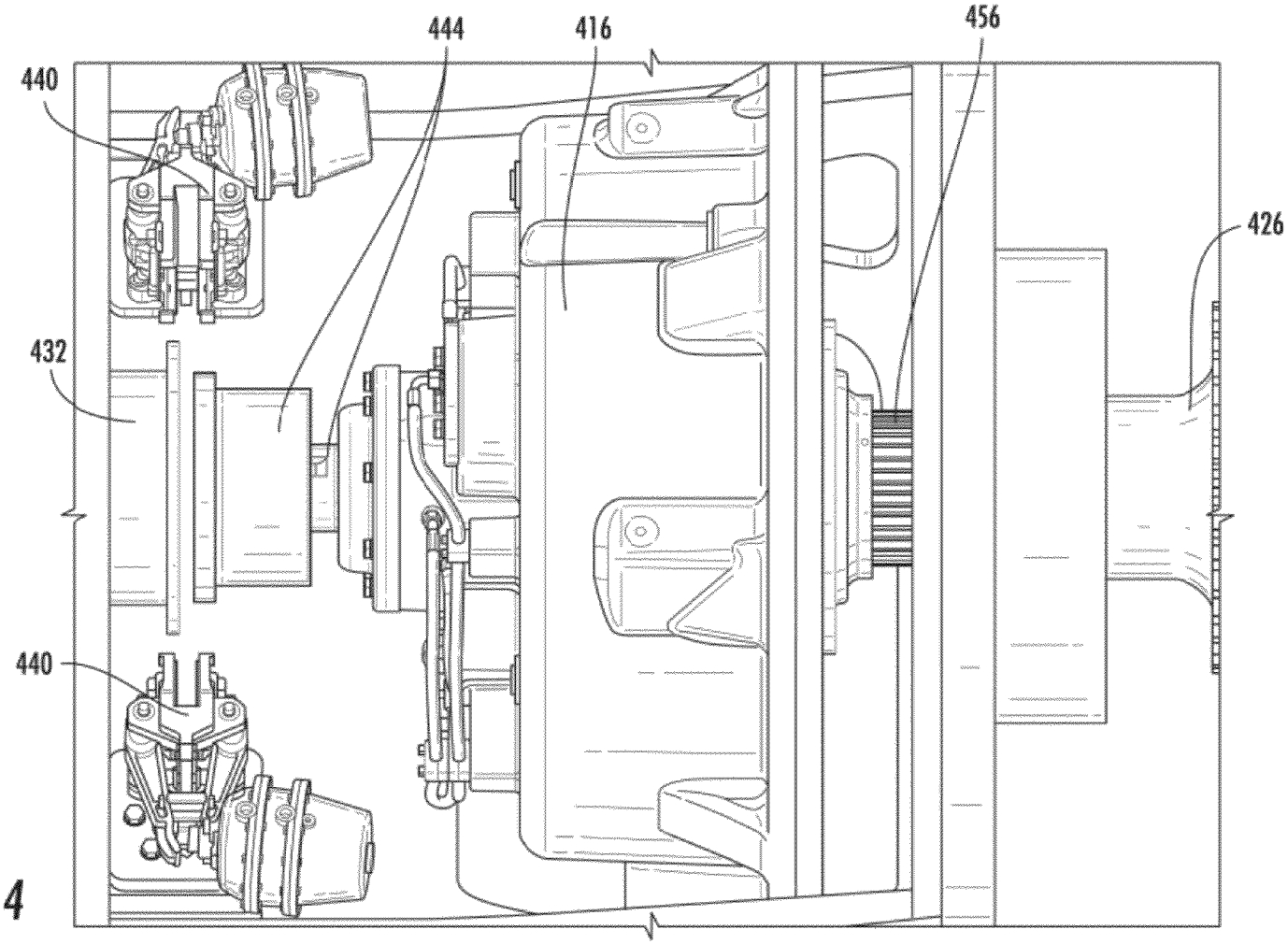
FIG. 14 is a perspective view of the cartridge assembly of FIG. 13 in a second configuration.
Figure 15:
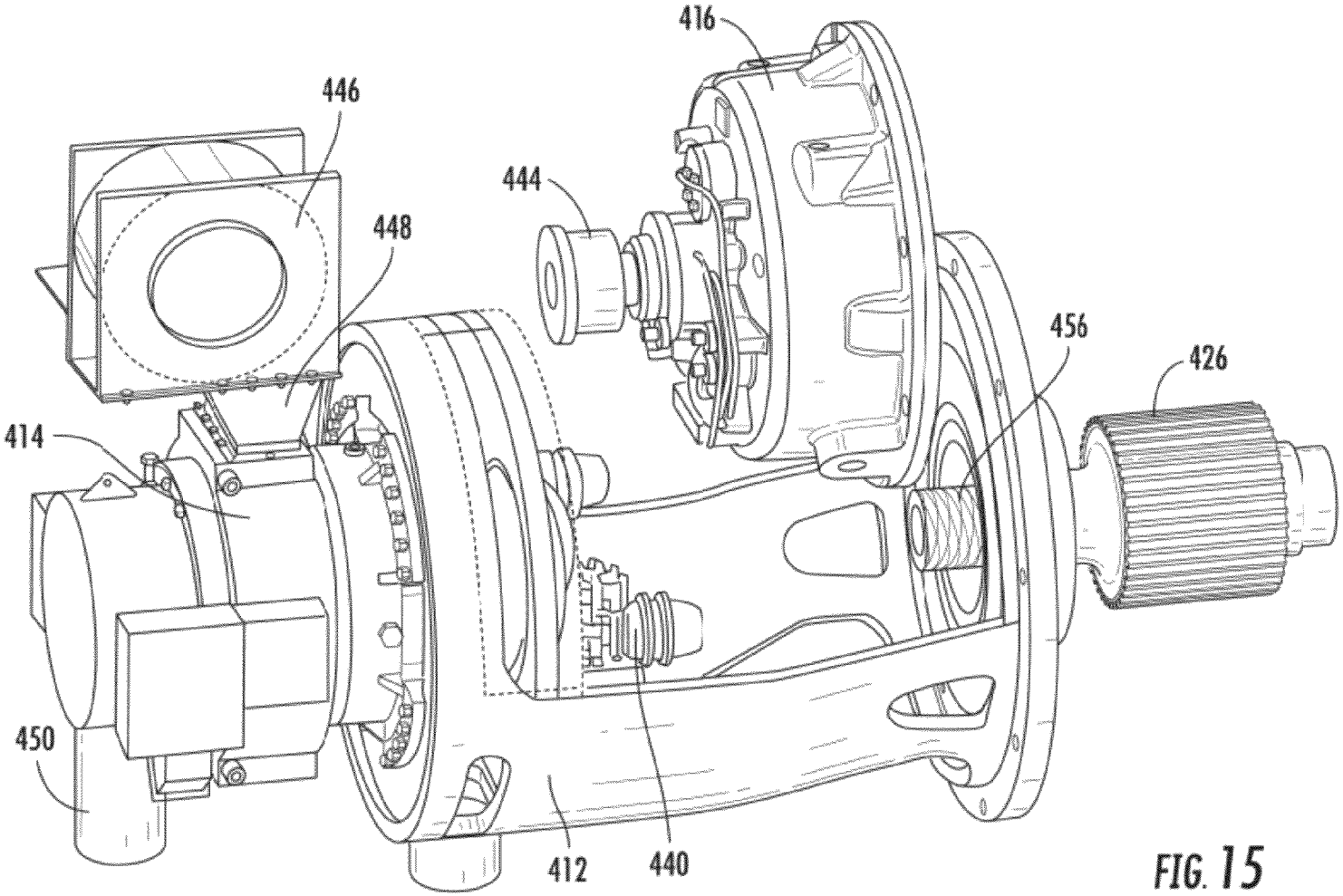
FIG. 15 is a perspective view of the cartridge assembly of FIG. 13 in a third configuration.

Referring to FIGS. 13-15, the gear reduction 416 may be removed to be repaired or replaced using the overhead crane system. The cover 420 of the housing 412 is removed to provide access to the gear reduction 416 and provide clearance for the removal of the gear reduction 416. The motor coupling 442 is separated and/or removed to disconnect the motor 414 from the gear reduction 416 (see FIG. 13). A support may be coupled to the gear reduction 416 or an integral ring formed therein to provide structure that may be engaged by the overhead crane system. The support is preferably located such that it is aligned with the center of gravity of the gear reduction 416. With the support of the overhead crane, the gear reduction 416 may then be disconnected from the housing 412 of the cartridge assembly 410 and pulled sideways until the input shaft 456 of the pinion assembly 418 is clear of the output port 452 of the gear reduction 416 (see FIG. 14). The gear reduction 416 may then be lifted free (see FIG. 15). To install the gear reduction 416, the process may be reversed.

While the removal and assembly of components may be accomplished with an overhead crane system, other mechanisms or processes may be used. For example, components may be moved by hand or with a fork lift, truck, etc.

According to an exemplary embodiment, each cartridge assembly 410 of a hoist and/or drag system is configured to work independently from other cartridge assemblies 410 of the system. For example, if one cartridge assembly 410 driving the drum 466 stops, the stopped cartridge assembly 410 may be decoupled from the system, such as by removing the pinion assembly 418 or decoupling the motor coupling 442. Accordingly the stopped cartridge assembly 410 or a component thereof may be removed, replaced, repaired, etc. The hoist and/or drag system may then resume operation without the stopped (decoupled) cartridge assembly 410, at a reduced capacity. The independent functionality of each cartridge assembly 410 allows for a significant reduction in the downtime of the system, when compared to processes in which equipment, such as a dragline, is shut down while replacement parts are obtained and installed.

According to an exemplary embodiment, the cartridge assemblies 410 and pedestals 424 allow for quick adjustment of the capacity of hoist and drag machinery. As discussed, the pedestal 424 for the hoist or drag drum 466 may include additional ports 460 (i.e., free or open ports) configured to receive additional cartridge assemblies 410. Accordingly, a dragline or power shovel employing the cartridge assemblies 410 and pedestals 424 may therefore be configured to operate at a first capacity, while having the capability to be quickly upgraded to a second, higher capacity.

According to an exemplary embodiment, multiple pieces of equipment (e.g., dragline and power shovel) at a work site may be designed to use identical (or interchangeable) cartridge assemblies 410 and pedestals 424. One or more spare cartridge assemblies 410 or components for the cartridge assemblies 410 may be kept on-site to quickly repair or replace parts, as needed. Additionally, upgraded motors, gear reductions, or other components may be provided to quickly and easily upgrade equipment configured to use the cartridge assemblies 410.

The construction and arrangements of the dragline hoist and drag system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. The technology described can also be provided in other walking or moving excavating machines, and particularly in mining shovels. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. Equipment for mining and excavating, comprising:
- a bucket configured to remove overburden;
- a boom for positioning the bucket;
- a hoist cable and a drag cable for controlling the bucket;
- a drum configured to wind at least one of the hoist cable or the drag cable thereon;
- a pedestal supporting the drum, and surrounding a bull gear coupled to the drum;
- a pinion extending within a port in the pedestal and engaging the bull gear; and
- a cartridge assembly coupled to the pedestal, the cartridge assembly comprising:
  - an electric motor having a shaft extending therefrom, and
  - a gear reduction coupled to the shaft, wherein the pinion is driven by the motor via the gear reduction, and
- wherein the pedestal is configured to allow the pinion to be removed or installed without decoupling the cartridge assembly from the pedestal.

2. The equipment of claim 1, further comprising a first auxiliary hoist system comprising pulleys and a hook for maneuvering the pinion through the pedestal, away from the cartridge assembly during removal or installation of the pinion.

3. The equipment of claim 2, further comprising a second auxiliary hoist system comprising pulleys and a hook for maneuvering the cartridge assembly, the motor, or the gear reduction during removal or installation of the cartridge assembly, the motor, or the gear reduction.

4. The equipment of claim 3, wherein the motor and the gear reduction are independently supported relative to the cartridge assembly such that removal or installation of either the motor or the gear reduction does not require decoupling the cartridge assembly from the pedestal.

5. The equipment of claim 4, wherein the motor and the gear reduction are independently supported relative to each other such that removal of the motor does not first require maneuvering the gear reduction out of the way of the motor, and removal of the gear reduction does not first require maneuvering the motor out of the way of the gear reduction.

6. The equipment of claim 1, wherein the pedestal includes three or more ports equally spaced from the center of the bull gear, wherein each of the ports is configured to receive a separate pinion to directly engage the bull gear.

7. The equipment of claim 6, wherein the pedestal is configured to support a separate cartridge assembly to drive each pinion, whereby the pedestal is configured to support a greater number of cartridge assemblies to increase a capacity of the equipment, and whereby the equipment is configured to be operated with a reduced number of cartridge assemblies while one or more of the cartridge assemblies is removed for repair or replacement.

8. Hoist and drag machinery for a dragline, comprising:
- a drum for winding a cable thereon;
- a bull gear coupled to the drum;
- a pedestal supporting the drum and the bull gear;
- a cartridge assembly fastened to the pedestal and comprising:
  - a housing,
  - a motor having an output shaft extending within the housing, and
  - a gear reduction coupled to the output shaft of the motor; and
- a pinion coupled to the gear reduction, wherein the pinion is configured to engage the bull gear;
- wherein the motor, the gear reduction, and the pinion are separately supported such that the motor is removable from the cartridge assembly without first maneuvering the gear reduction or the pinion, the gear reduction is removable from the cartridge assembly without first maneuvering either the motor or the pinion, and the pinion is separable from the gear reduction without first maneuvering the cartridge assembly.

9. The machinery of claim 8, wherein the pinion is supported within the pedestal, and wherein the cartridge assembly is removable from the pedestal without first removing the pinion from the pedestal.

10. The machinery of claim 9, wherein the cartridge assembly is fastened to a first side of the pedestal, and wherein the pinion is configured to be removed by pulling the pinion out of a second side of the pedestal.

11. The machinery of claim 10, further comprising an auxiliary hoist slidable on a rail coupled to the pedestal, wherein the auxiliary hoist is configured to support the pinion during removal of the pinion from the pedestal.

12. The machinery of claim 10, wherein the motor and the gear reduction are independently supported relative to the cartridge assembly such that removal or installation of either the motor or the gear reduction does not require decoupling the cartridge assembly from the pedestal.

13. The machinery of claim 8, wherein the cartridge assembly is a first cartridge assembly, and the hoist and drag machinery further comprises additional cartridge assemblies, wherein each of the additional cartridge assemblies comprises a housing, a motor, and a gear reduction, and wherein each of the gear reductions is coupled to a separate pinion.

14. The machinery of claim 13, wherein any one of the cartridge assemblies is configured to be switched with any other one of the cartridge assemblies without affecting performance of the hoist and drag machinery.

15. The machinery of claim 14, wherein the equipment is configured to allow for coupling of the cartridge assemblies to the pedestal on either end of the drum.

16. The machinery of claim 8, wherein the dragline is a walking dragline, wherein the motor is an electric motor, wherein the cable is a steel cable, wherein the cartridge assembly further comprises a disk brake positioned between the gear reduction and a shaft of the motor, and wherein the gear reduction includes a planetary arrangement of gears.

17. A cartridge assembly for hoist and drag machinery, comprising:

a housing having a cover, wherein the cover is configured to provide access through a top of the housing;

an electric motor coupled to the housing, the motor comprising an output shaft extending within the housing;

a gear reduction having a planetary gear arrangement, wherein the gear reduction comprises an input shaft and an output port, wherein the output port is configured to be coupled to a pinion; and a motor coupling configured to align the output shaft of the electric motor and the input shaft of the gear reduction.

18. The cartridge assembly of claim 17, wherein the electric motor and the gear reduction are independently supported relative to each other such that removal of the electric motor does not first require maneuvering the gear reduction, and removal of the gear reduction does not first require maneuvering the electric motor.

19. The cartridge assembly of claim 18, further comprising a disk brake coupled to the output shaft of the electric motor, between the electric motor and the gear reduction.

20. The cartridge assembly of claim 19, wherein the electric motor is positioned adjacent to the housing, and wherein the disk brake, the motor coupling, and the gear reduction are positioned within the housing.

* * * * *